US009664073B2

(12) United States Patent
David et al.

(10) Patent No.: US 9,664,073 B2
(45) Date of Patent: May 30, 2017

(54) MODULAR ELECTRICALLY ACTUATED CAMSHAFT PHASER

(71) Applicant: DELPHI TECHNOLOGIES, INC., Troy, MI (US)

(72) Inventors: Pascal David, Beidweiler (LU); Pierre Kimus, Attert (BE); Paul R. Van Heyningen, Fairport, NY (US)

(73) Assignee: Delphi Technologies, Inc., Troy, MI (US)

( * ) Notice: Subject to any disclaimer, the term of this patent is extended or adjusted under 35 U.S.C. 154(b) by 85 days.

(21) Appl. No.: 14/621,799

(22) Filed: Feb. 13, 2015

(65) Prior Publication Data

US 2015/0240674 A1 Aug. 27, 2015

Related U.S. Application Data

(60) Provisional application No. 61/944,112, filed on Feb. 25, 2014.

(51) Int. Cl.

| | |
|---|---|
| ***F01L 1/34*** | (2006.01) |
| ***F01L 1/352*** | (2006.01) |
| *F01L 1/344* | (2006.01) |

(52) U.S. Cl.

CPC ..... *F01L 1/352* (2013.01); *F01L 1/34* (2013.01); *F01L 2001/34483* (2013.01); *F01L 2001/3521* (2013.01)

(58) Field of Classification Search

CPC ... F01L 1/34; F01L 1/352; F01L 2001/34483; F01L 2001/3521

USPC ..... 123/90.15, 90.17

See application file for complete search history.

(56) References Cited

U.S. PATENT DOCUMENTS

| | | | | |
|---|---|---|---|---|
| 4,770,060 | A | 9/1988 | Elrod et al. | |
| 4,771,742 | A | 9/1988 | Nelson et al. | |
| 5,136,887 | A | 8/1992 | Elrod et al. | |
| 5,161,429 | A | 11/1992 | Elrod et al. | |
| 5,253,546 | A | 10/1993 | Elrod et al. | |
| 5,417,186 | A * | 5/1995 | Elrod | F01L 1/02 123/90.17 |
| 6,257,186 | B1 | 7/2001 | Heer | |

(Continued)

FOREIGN PATENT DOCUMENTS

| | | |
|---|---|---|
| EP | 1813783 B1 | 5/2008 |
| EP | 2386732 A1 | 11/2011 |

(Continued)

*Primary Examiner* — Ching Chang

(74) *Attorney, Agent, or Firm* — Joshua M. Haines

(57) ABSTRACT

A camshaft phaser for controllably varying the phase relationship between a crankshaft and a camshaft of an internal combustion engine includes a housing connectable to the crankshaft and having a housing bore extending therethrough along an axis. A back cover is attached to one axial end of the housing while a front cover is attached to the other axial end of the housing. An output hub connectable to the camshaft is disposed coaxially within the housing and captured axially between the back cover and the front cover. A harmonic gear drive unit is disposed operationally between the housing and the output hub and is connected to a rotational actuator for imparting rotation on the harmonic gear drive unit such that rotation of the harmonic gear drive unit by the rotational actuator causes relative rotation between the housing and the output hub.

11 Claims, 4 Drawing Sheets

(56) References Cited

U.S. PATENT DOCUMENTS

| | | | | |
|---|---|---|---|---|
| 6,302,073 | B1 | 10/2001 | Heer | |
| 6,328,006 | B1 | 12/2001 | Heer | |
| 6,981,478 | B2 | 1/2006 | Schäfer et al. | |
| 7,421,990 | B2 * | 9/2008 | Taye | F01L 1/344 123/90.17 |
| 7,673,598 | B2 | 3/2010 | Schaefer et al. | |
| 8,322,318 | B2 | 12/2012 | David et al. | |
| 8,424,500 | B2 | 4/2013 | David et al. | |
| 8,516,983 | B2 | 8/2013 | David et al. | |
| 9,151,191 | B1 * | 10/2015 | David | F01L 1/352 123/90.17 |
| 2010/0288216 | A1 | 11/2010 | Takahashi et al. | |
| 2011/0030631 | A1 | 2/2011 | David et al. | |
| 2011/0030632 | A1 | 2/2011 | David et al. | |
| 2011/0277713 | A1 | 11/2011 | David et al. | |
| 2011/0315102 | A1 | 12/2011 | David et al. | |
| 2012/0053817 | A1 | 3/2012 | Gauthier et al. | |
| 2012/0145104 | A1 | 6/2012 | David et al. | |
| 2012/0291729 | A1 | 11/2012 | David et al. | |
| 2012/0312258 | A1 | 12/2012 | Kimus et al. | |
| 2013/0008398 | A1 | 1/2013 | Stoltz-Douchet et al. | |
| 2013/0019825 | A1 | 1/2013 | Fischer | |
| 2014/0366821 | A1 | 12/2014 | David et al. | |

FOREIGN PATENT DOCUMENTS

| | | | |
|---|---|---|---|
| JP | H0267405 | A | 3/1990 |
| WO | 9500748 | A1 | 1/1995 |
| WO | 2005080757 | A1 | 9/2005 |

* cited by examiner

MODULAR ELECTRICALLY ACTUATED CAMSHAFT PHASER

CROSS-REFERENCE TO RELATED PATENT APPLICATIONS

This patent application claims the benefit of U.S. provisional patent application Ser. No. 61/944,112 filed on Feb. 25, 2014, the disclosure of which is hereby incorporated by reference in its entirety.

TECHNICAL FIELD OF INVENTION

The present invention relates to a camshaft phaser which uses an electric motor and a harmonic gear drive unit to vary the phase relationship between a crankshaft and a camshaft of an internal combustion engine; more particularly, to such a camshaft phaser which is modular in nature.

BACKGROUND OF INVENTION

Camshaft phasers for varying the timing of combustion valves in internal combustion engines are well known. A first element, known generally as a sprocket element, is driven by a chain, belt, or gearing from the crankshaft of the internal combustion engine. A second element, known generally as a camshaft plate, is mounted to the end of a camshaft of the internal combustion engine. A common type of camshaft phaser used by motor vehicle manufactures is known as a vane-type camshaft phaser. U.S. Pat. No. 7,421,989 shows a typical vane-type camshaft phaser which generally comprises a plurality of outwardly-extending vanes on a rotor interspersed with a plurality of inwardly-extending lobes on a stator, forming alternating advance and retard chambers between the vanes and lobes. Engine oil is supplied via a multiport oil control valve, in accordance with an engine control module, to either the advance or retard chambers, to change the angular position of the rotor relative to the stator, and consequently the angular position of the camshaft relative to the crankshaft, as required to meet current or anticipated engine operating conditions.

While vane-type camshaft phasers are effective and relatively inexpensive, they do suffer from drawbacks such as slow operation at low engine speeds due to low oil pressure, slow operation at low engine temperatures due to high oil viscosity, increased oil pump capacity requirement for the oil pump used to lubricate the internal combustion because the same pump is used to actuate the vane-type camshaft phaser, and the total amount of phase authority provided by vane-type camshaft phasers is limited by the amount of space between adjacent vanes and lobes and may not be sufficient to provide the desired amount of phase authority. For at least these reasons, the automotive industry is developing electrically driven camshaft phasers.

One type of electrically driven camshaft phaser being developed uses a harmonic gear drive unit, actuated by an electric motor, to change the angular position of the camshaft relative to the crankshaft. One example of such a camshaft phaser is shown in United States Patent Application Publication No. US 2012/0312258 A1 to Kimus et al. While the camshaft phaser of Kimus et al. may be effective, adaptation to different engine designs may require significant changes to multiple components of the camshaft phaser.

What is needed is an electrically driven camshaft phaser which minimizes or eliminates one of more of the shortcomings as set forth above.

SUMMARY OF THE INVENTION

Briefly described, a camshaft phaser is provided for controllably varying the phase relationship between a crankshaft and a camshaft of an internal combustion engine. The camshaft phaser includes a housing connectable to the crankshaft and having a housing bore extending therethrough along an axis. A back cover is attached to one axial end of the housing while a front cover is attached to the other axial end of the housing. An output hub connectable to the camshaft is disposed coaxially within the housing and captured axially between the back cover and the front cover. A harmonic gear drive unit is disposed operationally between the housing and the output hub and is connected to a rotational actuator for imparting rotation on the harmonic gear drive unit such that rotation of the harmonic gear drive unit by the rotational actuator causes relative rotation between the housing and the output hub. By having the housing bore extend through the housing along with the back cover attached to one axial end of the housing while the front cover is attached to another axial end of the housing, the camshaft phaser can be easily adapted to multiple engine configurations by providing housings of different designs that accommodate each engine configuration while allowing the other components to remain the same for each engine configuration.

BRIEF DESCRIPTION OF DRAWINGS

This invention will be further described with reference to the accompanying drawings in which.

DETAILED DESCRIPTION OF INVENTION

Figure 1A:
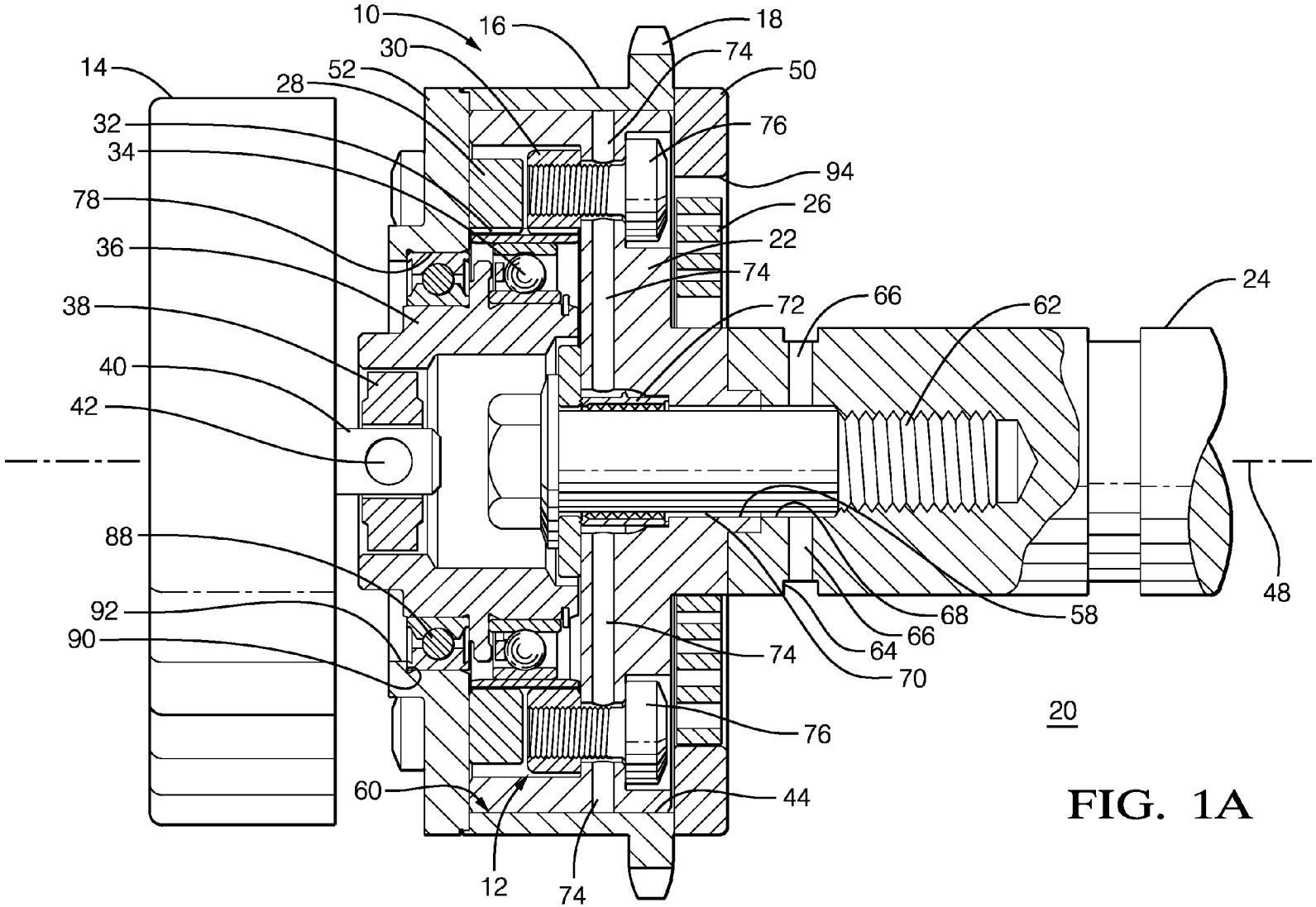
FIGS. 1A, 1B, and 1C are axial cross-sectional views of a camshaft phaser in accordance with the present invention taken at three different circumferential locations of the camshaft phaser.
Figure 1C:
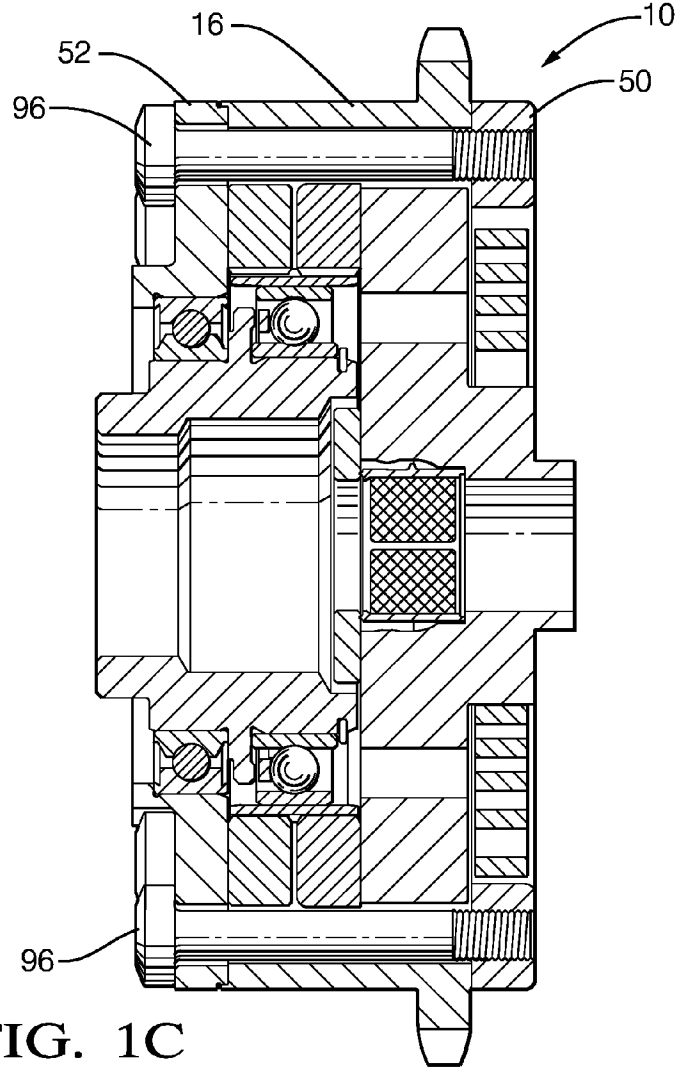
Figure 1B:
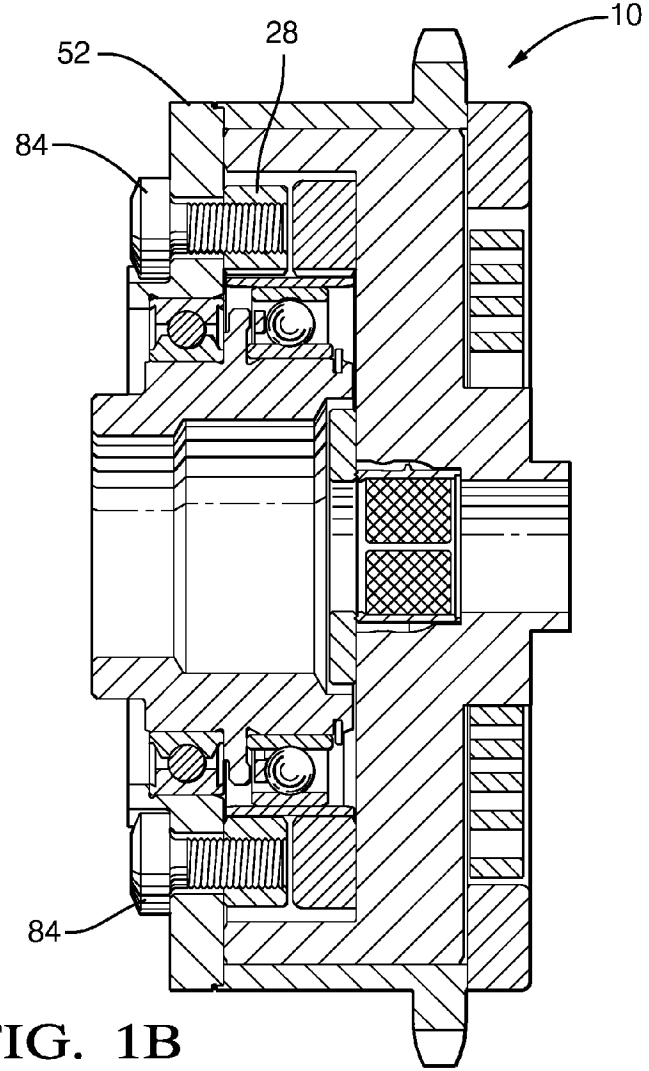

Referring to FIGS. 1A-1C, a camshaft phaser 10 in accordance with the present invention is shown which is modular in nature. Camshaft phaser 10 comprises a harmonic gear drive unit 12; a rotational actuator illustrated as electric motor 14 (shown only in FIG. 1A) which is operationally connected to harmonic gear drive unit 12 and which may be a DC electric motor; a housing 16 with an input sprocket 18 operationally connected to harmonic gear drive unit 12 and drivable by a crankshaft (not shown) of an internal combustion engine 20; an output hub 22 operationally connected to harmonic gear drive unit 12 and mountable to an end of a camshaft 24 (shown only in FIG. 1A) of internal combustion engine 20; and a bias spring 26 operationally disposed between output hub 22 and input sprocket 18.

Harmonic gear drive unit 12 comprises an outer first spline 28 which may be either a circular spline or a dynamic spline as described below; an outer second spline 30 which is the opposite (dynamic or circular) of outer first spline 28 and is coaxially positioned adjacent outer first spline 28; a flexspline 32 disposed radially inward of both outer first spline 28 and outer second spline 30 and having outwardly-extending gear teeth disposed for engaging inwardly-extending gear teeth on both outer first spline 28 and outer second spline 30; and a wave generator 34 disposed radially inwards of and engaging flexspline 32.

Flexspline 32 is a non-rigid ring with external teeth on a slightly smaller pitch diameter than the circular spline. Flexspline 32 is fitted over and elastically deflected by wave generator 34.

The circular spline (either outer first spline 28 or outer second spline 30) is a rigid ring with internal teeth engaging the teeth of flexspline 32 across the major axis of wave generator 34. The circular spline may serve as the input member.

The dynamic spline (whichever of outer first spline 28 and outer second spline 30 that is not the circular spline) is a rigid ring having internal teeth of the same number as flexspline 32. The dynamic spline rotates together with flexspline 32 and may serve as the output member. Either the dynamic spline or the circular spline may be identified by a chamfered corner at its outside diameter to distinguish the circular spline from the dynamic spline.

Wave generator 34 is an assembly of an elliptical steel disc supporting an elliptical bearing, the combination defining a wave generator plug. A flexible bearing retainer surrounds the elliptical bearing and engages flexspline 32. Rotation of the wave generator plug causes a rotational wave to be generated in flexspline 32 (actually two waves 180° apart, corresponding to opposite ends of the major ellipse axis of the disc).

During assembly of harmonic gear drive unit 12, the outwardly extending teeth of flexspline 32 engage the inwardly extending teeth of the circular spline and the dynamic spline along and near the major elliptical axis of wave generator 34. The dynamic spline has the same number of teeth as flexspline 32, so rotation of wave generator 34 causes no net rotation per revolution therebetween. However, the circular spline has slightly fewer gear teeth than does the dynamic spline, and therefore the circular spline rotates past the dynamic spline during rotation of the wave generator plug, defining a gear ratio therebetween (for example, a gear ratio of 50:1 would mean that 1 rotation of the circular spline past the dynamic spline corresponds to 50 rotations of the wave generator 34). Harmonic gear drive unit 12 is thus a high-ratio gear transmission; that is, the angular phase relationship between outer first spline 28 and outer second spline 30 changes by 2% for every revolution of wave generator 34.

Of course, as will be obvious to those skilled in the art, the circular spline rather may have slightly more teeth than the dynamic spline has, in which case the rotational relationships described below are reversed. Further features of harmonic gear drive unit 12 are described in U.S. Pat. No. 8,516,983 to David et al., the disclosure of which is incorporated herein by reference in its entirety.

Wave generator 34 includes a coupling adaptor 36 that is mounted thereto or formed integrally therewith. A coupling 38 is mounted to a motor shaft 40 of electric motor 14 and pinned thereto by a pin 42. Coupling 38 engages coupling adaptor 36, permitting wave generator 34 to be rotationally driven by electric motor 14, as may be desired to alter the phase relationship between outer first spline 28 and outer second spline 30. Electric motor 14, coupling 38, motor shaft 40, and pin 42 are shown only in FIG. 1A. Further features of coupling adaptor 36 and coupling are disclosed in U.S. patent application Ser. No. 13/112,199 to David et al., now U.S. Pat. No. 8,800,513 to David et al., the disclosures of which are incorporated herein by reference in their entirety.

Still referring to FIGS. 1A-1C, housing 16, which acts as in input member to camshaft phaser 10, is centered about an axis 48 about which camshaft 24 rotates. Housing 16 includes a housing bore 44 extending coaxially therethrough within which output hub 22 and harmonic gear drive unit 12 are coaxially located. A back cover 50 is attached to an axial end of housing 16 that is proximal to camshaft 24 while a front cover 52 is fixed to the axial end of housing 16 that is opposite back cover 50. Back cover 50 and front cover 52 will be described in greater detail later.

Output hub 22, which acts as an output member for camshaft phaser 10, includes a central through bore 58 extending coaxially therethrough. Output hub 22 is disposed coaxially within housing 16 and mates with housing bore 44, thereby defining a journal bearing interface 60 between output hub 22 and housing 16 which substantially prevents tipping and radial movement of output hub 22 within housing 16 while allowing output hub 22 to rotate within housing 16. Output hub 22 is attached to camshaft 24 by a camshaft phaser attachment bolt 62 (shown only in FIG. 1A) which extends through central through bore 58 and threadably engages camshaft 24. In this way, output hub 22 is clamped securely to camshaft 24 and relative rotation between output hub 22 and camshaft 24 is prevented.

In order to ensure smooth operation and provide resistance to wear, journal bearing interface 60 may be supplied with oil, for example, from internal combustion engine 20. Oil under pressure may be supplied via an oil gallery (not shown) of internal combustion engine 20 to a camshaft annular oil groove 64 of camshaft 24. The oil is then communicated through radial camshaft oil passages 66 to a camshaft counter bore 68 which extends axially into camshaft 24. From the camshaft counter bore 68, the oil is communicated to an annular space 70 formed radially between camshaft phaser attachment bolt 62 and central through bore 58 of output hub 22. From annular space 70, the oil is passed through a filter 72 located within central through bore 58 of output hub 22 and is communicated to journal bearing interface 60 through output hub oil passages 74 that extend radially outward through output hub 22 to journal bearing interface 60 from central through bore 58 of output hub 22.

Outer second spline 30 is secured coaxially to output hub 22 with bolts 76 as best shown in FIG. 1A. Bolts 76 extend through output hub 22 and threadably engage outer second spline 30, thereby securely clamping outer second spline 30 to output hub 22 and thereby preventing relative rotation between outer second spline 30 and output hub 22. In this way, output hub 22 rotates with outer second spline 30 in a one-to-one relationship. It should be noted that radial clearance is provided between bolts 76 and output hub 22, thereby allowing oil to flow uninterrupted through output hub oil passages 74.

Front cover 52 includes a front cover bore 78 extending axially thereinto centered about axis 48 from the end of front cover 52 that mates with housing 16. Outer first spline 28 is secured to front cover 52 by bolts 84 (best shown in FIG. 1B) which pass through front cover 52 and threadably engage outer first spline 28. Front cover bore 78 receives a bearing 88 coaxially therewithin such that bearing 88 is fixed within front cover bore 78, for example, by press fit. Bearing 88 radially supports coupling adaptor 36/wave generator 34 and allows coupling adaptor 36/wave generator 34 to rotate relative to front cover 52 in use. Bearing 88 may be axially indexed by a front cover shoulder 90 which terminates front cover bore 78. The end of front cover 52 that is distal from housing 16 includes a front cover through bore 92 extending coaxially therethrough in order to allow coupling adaptor 36 to extend therethrough. Oil leaving journal bearing interface 60 may subsequently provide lubrication to bearing 88, harmonic gear drive unit 12, and the interface between coupling adaptor 36 and coupling 38. Additional oil passages may branch off from one or more of output hub oil passages 74 in order to provide lubrication to bearing 88, harmonic gear drive unit 12, and the interface between coupling adaptor 36 and coupling 38.

Back cover 50 is substantially annular in shape and centered about axis 48, thereby defining a back cover through bore 94 coaxially therethrough. Back cover through bore 94 allows a portion of output hub 22 to pass therethrough, thereby allowing output hub 22 to engage camshaft 24. Back cover 50, housing 16, and front cover 52 are fixed to each other by bolts 96 (best shown in FIG. 1C) which extend through front cover 52 and housing 16 and threadably engage back cover 50. In this way, bolts 96 clamp back cover 50, housing 16, and front cover 52 securely together, thereby preventing relative rotation between back cover 50, housing 16, and front cover 52.

Bias spring 26 is located within back cover through bore 94 and radially surrounds the portion of output hub 22 that extends into back cover through bore 94. Bias spring 26 may be a clock spring where one end (not shown) of bias spring 26 is fixed to the output hub 22 with the other end (not shown) of bias spring 26 is attached to back cover 50. In the event of a malfunction of electric motor 14, bias spring 26 is biased to back-drive harmonic gear drive unit 12 without help from electric motor 14 to a predetermined rotational position of outer second spline 30. The predetermined position may be a position which allows internal combustion engine 20 to start or run, and the predetermined position may be at one of the extreme ends of the range of authority or intermediate of the phaser's extreme ends of its rotational range of authority. For example, the rotational range of travel in which bias spring 26 biases harmonic gear drive unit 12 may be limited to something short of the end stop position of the phaser's range of authority. Such an arrangement would be useful for internal combustion engines requiring an intermediate park position for idle or restart.

In operation, when a change of phase is desired between the crankshaft of internal combustion engine 20 and camshaft 24, motor shaft 40 of electric motor 14 is rotated by applying an electric current to electric motor 14. It should be noted that motor shaft 40 may be rotated either clockwise or counterclockwise as determined by whether it is desired to advance or retard camshaft 24 relative to the crankshaft. Rotation of motor shaft 40 causes wave generator 34 to rotate which causes a rotational wave to be generated in flexspline 32, thereby causing outer first spline 28 to rotate relative to outer second spline 30. Since outer first spline 28 is fixed to housing 16 and outer second spline 30 is fixed to output hub 22, output hub 22 also rotates relative to housing 16, thereby changing the phase relationship between camshaft 24 and the crankshaft.

Harmonic gear drive unit 12, electric motor 14, output hub 22, bias spring 26, back cover 50, and front cover 52 define a base unit which allows different housings to be applied thereto in order to adapt the camshaft phaser for use in different engine applications. As illustrated above, housing 16 includes an input sprocket 18. Input sprocket 18 is engaged with a chain (not shown) which is driven by the crankshaft of internal combustion engine 20. Chains that are used to drive camshaft phasers are typically compatible with oil that is used to lubricate the camshaft phaser, and consequently, measures do not need to be taken to seal the camshaft phaser to prevent oil from coming into contact with the chain. However, some internal combustion engines employ a belt, rather than a chain. Some belts are not compatible with the oil used to lubricate the camshaft phaser, consequently, it is necessary to seal the camshaft phaser as will be described in the paragraphs that follow.

Figure 2:
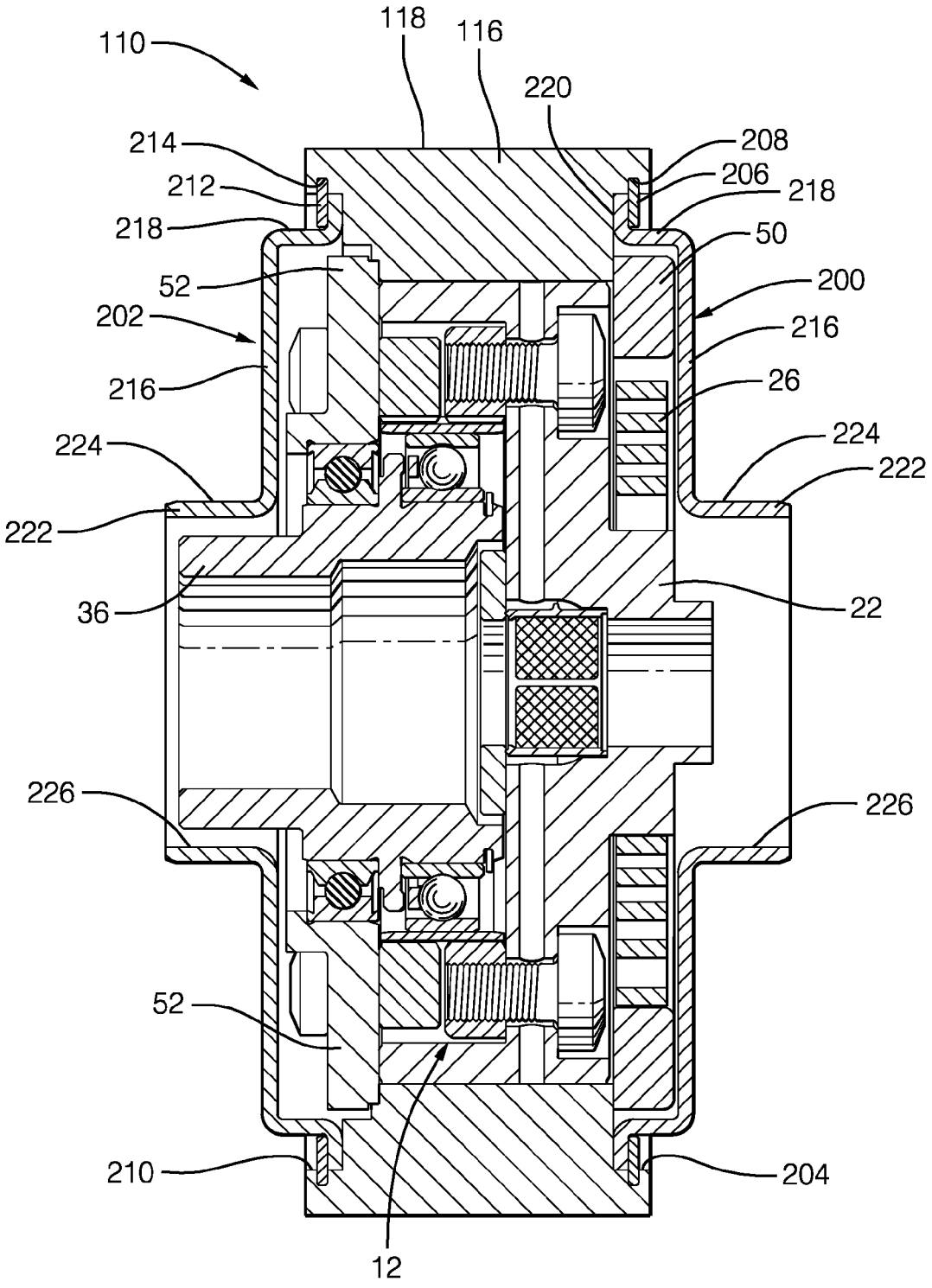
FIG. 2 is an axial cross-sectional view of a second camshaft phaser in accordance with the present invention.

Now with reference to FIG. 2, camshaft phaser 110 is shown which is substantially identical to camshaft phaser 10 as described above in that camshaft phaser 110 includes harmonic gear drive unit 12, electric motor 14 (not shown in FIG. 2), output hub 22, bias spring 26, back cover 50, and front cover 52. Camshaft phaser 110 differs from camshaft phaser 10 in that housing 16 has been replaced with housing 116. Housing 116 includes a toothed input pulley 118, rather than input sprocket 18, which interfaces with a corresponding toothed belt (not shown) driven by the crankshaft of internal combustion engine 20.

Housing 116 includes a back sealing cover 200 and a front sealing cover 202 in order to prevent oil used to lubricate camshaft phaser 110 from reaching the belt which engages input pulley 118. Back sealing cover 200 is sealingly received within a back counter bore 204 of housing 116 which extends coaxially into housing 116 from the same side thereof which mates with back cover 50. Back sealing cover 200 may be press fit within back counter bore 204 and secured thereto with a back snap ring 206 which is received within a back snap ring groove 208 formed radially outward from back counter bore 204. Similarly, front sealing cover 202 is sealingly received within a front counter bore 210 which extends coaxially into housing 116 from the same side thereof which mates with front cover 52. Front sealing cover 202 may be press fit within front counter bore 210 and secured thereto with a front snap ring 212 which is received within a front snap ring groove 214 formed radially outward from front counter bore 210.

Back sealing cover 200 and front sealing cover 202 may be substantially identically and consequently will now be described concurrently. Back sealing cover 200 and front sealing cover 202 each include an annular plate 216 which is coaxial with housing 116. An annular wall 218 extends axially toward housing 116 from the outer perimeter of plate 216. An annular attachment flange 220 extends radially outward from the end of annular wall 218 that distal from plate 216. Attachment flange 220 of back sealing cover 200 mates with the bottom of back counter bore 204 while attachment flange 220 of front sealing cover 202 mates with the bottom of front counter bore 210. A sealing body 222 extends axially away from the inner perimeter of plate 216 in a direction that is opposite of annular wall 218. Sealing body 222 is annular in shape, thereby defining a sealing surface 224 on the outer circumference thereof and a central passage 226 extending coaxially therethrough. Central passage 226 of back sealing cover 200 allows camshaft 24 (shown in FIG. 1) to pass therethrough in order to mate with output hub 22 while central passage 226 of front sealing cover 202 accommodates coupling adaptor 36 and allows coupling 38 (shown in FIG. 1) to mate with coupling adaptor 36. Sealing surfaces 224 mate with dynamic seals (not show) of internal combustion engine 20 as disclosed in U.S. patent application Ser. No. 13/920,182 to Kimus et al., now United States Patent Application Publication No. US 2014/0366821 to Kimus et al., the disclosures of which are incorporated herein by reference in their entirety. In this way, oil used to lubricate camshaft phaser 110 is prevented from reaching the belt which engages input pulley 118.

Figure 3:
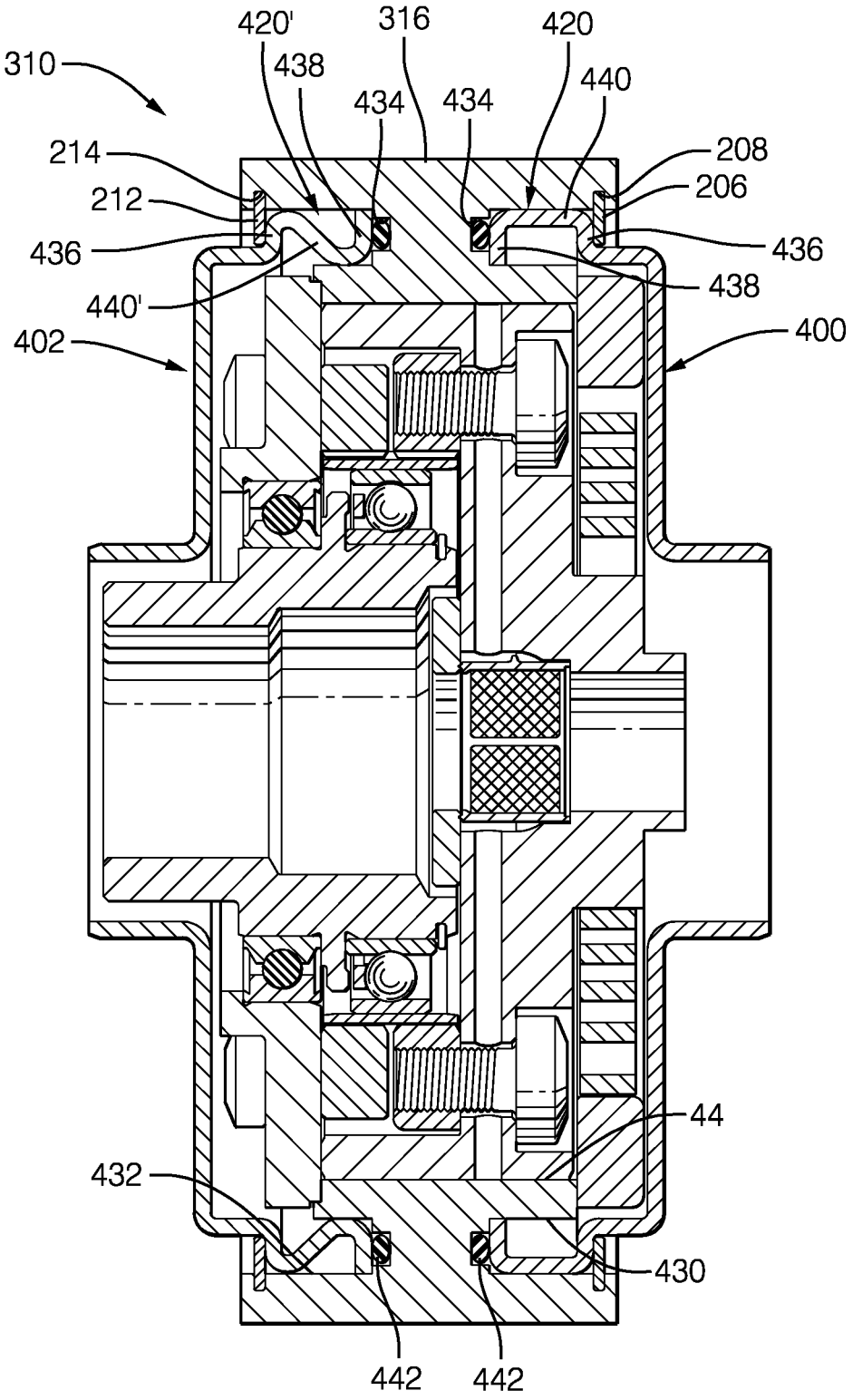
FIG. 3 is an axial cross-section view showing a variation of FIG. 2.

Now with reference to FIG. 3, camshaft phaser 310 is shown which is substantially identical to camshaft phaser 110 except that housing 116 has been replaced with housing 316, back sealing cover 200 has been replaced with back sealing cover 400, and front sealing cover 202 has been replaced with front sealing cover 402.

Housing 316 of camshaft phaser 310 is substantially identical to housing 116 of camshaft phaser 110 except that housing 316 includes a back annular recess 430 for receiving back sealing cover 400 sealingly therein and a front annular recess 432 for receiving front sealing cover 402 sealingly therein. Back annular recess 430 and front annular recess 432 extend coaxially into housing 316 such that a portion of each back annular recess 430 and front annular recess 432 radially surround a portion of housing bore 44 which extends through housing 316. In this way, the mass of housing 316 is reduced. O-ring grooves 434 are provided at the bottom of each of back annular recess 430 and front annular recess 432 as will be described in greater detail later. Back sealing cover 400 is secured within back annular recess 430 with back snap ring 206 which is received within back snap ring groove 208 formed radially outward in housing 316. Similarly, front sealing cover 402 is secured within front annular recess 432 with front snap ring 212 which is received within front snap ring groove 214 formed radially outward in housing 316.

Back sealing cover 400 is substantially identical to back sealing cover 200 except that attachment flange 220 is replaced with attachment flange 420. Attachment flange 420 includes an annular outer portion 436 which abuts back snap ring 206, an annular inner portion 438 which is substantially parallel to annular outer portion 436 and abuts the bottom of back annular recess 430, and a connecting wall 440 joining the radially outward portions of annular outer portion 436 and annular inner portion 438. In this way, attachment flange 420 has a cross section that is substantially C-shaped. Back sealing cover 400 is maintained in coaxial relationship with housing 316 by connecting wall 440 engaging the radial outward portion of back annular recess 430. Back sealing cover 400 is sealed to housing 316 by a first O-ring 442 which is disposed in O-ring groove 434 and compressed between O-ring groove 434 and annular inner portion 438 of attachment flange 420.

Front sealing cover 402 is substantially identical to back sealing cover 400 except that attachment flange 420 is replaced with attachment flange 420' where connecting wall 440 is replaced with connecting wall 440'. Connecting wall 440' extends diagonally between annular outer portion 436 and annular inner portion 438 such that connecting wall 440' joins the radially outward portion of annular outer portion 436 and the radially inward portion of annular inner portion 438. In this way, attachment flange 420 has a cross section that is substantially Z-shaped. Front sealing cover 402 is maintained in coaxial relationship with housing 316 by connecting wall 440' engaging the radial inward portion of front annular recess 432. Front sealing cover 402 is sealed to housing 316 by a second O-ring 444 which is disposed in O-ring groove 434 and compressed between O-ring groove 434 and annular inner portion 438 of attachment flange 420'.

While camshaft phaser 310 has been illustrated with back sealing cover 400 and front sealing cover 402 having different attachment flanges 420, 420' respectively, it should be understood that this has been done for illustrative purposes only to show possible design variations, and one attachment flange design would typically be chosen that would be used for both back sealing cover 400 and front sealing cover 402 for communization.

As should now be readily apparent, the modular nature of the camshaft phasers disclosed herein allows for adaptation to different internal combustion engine arrangements by using common components with the exception of the housing which is tailored to allow the camshaft phaser to be used in a particular internal combustion engine arrangement. With the need to only substitute the housing in order to apply the camshaft phaser to a particular internal combustion engine, costs are reduced, particularly when adapting the camshaft phaser to a low-volume internal combustion engine where the cost of adapting the camshaft phaser is divided by a small number of units manufactured.

We claim:

1. A camshaft phaser for controllably varying the phase relationship between a crankshaft and a camshaft in an internal combustion engine, said camshaft phaser comprising:

a housing connectable to said crankshaft and having a housing bore extending therethrough along an axis;

a back cover attached to one axial end of said housing;

a front cover attached to another axial end of said housing; wherein said housing is clamped between said back cover and said front cover;

an output hub connectable to said camshaft and disposed coaxially within said housing and captured axially between said back cover and said front cover; and a harmonic gear drive unit disposed operationally between said housing and said output hub, said harmonic gear drive unit being connected to a rotational actuator which imparts rotation on said harmonic gear drive unit such that rotation of said harmonic gear drive unit by said rotational actuator causes relative rotation between said housing and said output hub;

a back sealing cover fixed to said one axial end of said housing; and a front sealing cover fixed to said another axial end of said housing;

wherein said back sealing cover and said front sealing cover are configured to mate with dynamic seals of said internal combustion engine.

2. A camshaft phaser as in claim 1 wherein said back cover is located axially between said back sealing cover and said housing.

3. A camshaft phaser as in claim 2 wherein said front cover is located axially between said front sealing cover and said housing.

4. A camshaft phaser as in claim 1 wherein:

said back sealing cover is sealingly received within a back counter bore of said housing, said back counter bore being coaxial with said housing bore; and said front sealing cover is sealingly received within a front counter bore of said housing, said front counter bore being coaxial with said housing bore.

5. A camshaft phaser as in claim 1 wherein said back sealing cover includes a sealing body that is annular in shape, thereby defining a sealing surface on the outer circumference of said sealing body and also defining a central passage extending coaxially through said back sealing cover.

6. A camshaft phaser as in claim 5 wherein said sealing body extends axially away from an annular plate of said back sealing cover in a direction that is away from said back cover.

7. A camshaft phaser as in claim 1 wherein said front sealing cover includes a sealing body that is annular in shape, thereby defining a sealing surface on the outer circumference of said sealing body and also defining a central passage extending coaxially through said back sealing cover.

8. A camshaft phaser as in claim 7 wherein said sealing body extends axially away from an annular plate of said front sealing cover in a direction that is away from said front cover.

9. A camshaft phaser as in claim 1 wherein:

said back sealing cover is sealingly received within a back annular recess of said housing, said back annular recess being coaxial with said housing bore; and said front sealing cover is sealingly received within a front annular recess of said housing, said front annular recess being coaxial with said housing bore.

10. A camshaft phaser as in claim 9 wherein:

a portion of said back annular recess radially surrounds said housing bore; and a portion of said front annular recess radially surrounds said housing bore.

11. A camshaft phaser for controllably varying the phase relationship between a crankshaft and a camshaft in an internal combustion engine, said camshaft phaser comprising:

a housing connectable to said crankshaft and having a housing bore extending therethrough along an axis;

a back cover attached to one axial end of said housing;

a front cover attached to another axial end of said housing;

an output hub connectable to said camshaft and disposed coaxially within said housing and captured axially between said back cover and said front cover; and a harmonic gear drive unit disposed operationally between said housing and said output hub, said harmonic gear drive unit being connected to a rotational actuator which imparts rotation on said harmonic gear drive unit such that rotation of said harmonic gear drive unit by said rotational actuator causes relative rotation between said housing and said output hub;

a back sealing cover fixed to said one axial end of said housing; and a front sealing cover fixed to said another axial end of said housing;

wherein said back sealing cover and said front sealing cover are configured to mate with dynamic seals of said internal combustion engine.

* * * * *